US005220242A

United States Patent [19]

Choi

[11] Patent Number: 5,220,242

[45] Date of Patent: Jun. 15, 1993

[54] CATHODE-RAY TUBE WITH A COIL-SHAPED HIGH RESISTANCE BODY

[75] Inventor: Woong B. Choi, Kyungsangbuk, Rep. of Korea

[73] Assignee: Goldstar Co., Ltd., Seoul, Rep. of Korea

[21] Appl. No.: 753,170

[22] Filed: Aug. 30, 1991

[30] Foreign Application Priority Data

Aug. 30, 1990 [KR] Rep. of Korea ..... 90-13166

[51] Int. Cl.[5] ..... H01J 29/88; H01J 29/92

[52] U.S. Cl. ..... 313/479; 313/477 HC; 313/450

[58] Field of Search ..... 313/479, 450, 477 HC

[56] References Cited

U.S. PATENT DOCUMENTS 3,355,617 11/1967 Schwartz et al. ..... 313/450

4,041,347 8/1977 Deal et al. ..... 313/479 X 4,220,893 9/1980 Miller et al. ..... 313/450

*Primary Examiner*—Palmer C. DeMeo

*Attorney, Agent, or Firm*—Morgan & Finnegan

[57] ABSTRACT

A high resistance body for supplying the high voltage of an anode terminal to the electrodes of an electron gun is coil-shaped. The anode terminal is mounted on the funnel portion of a glass bulb, and overlapped by a first conducting layer. The anode terminal is electrically connected to the electrodes of the electron gun comprising the coil-shaped high resistance body, second conducting layer and metal strip. The equivalent circuit comprises a resistance and condenser connected in parallel, at least an inductance generated by the coil-shaped high resistance body connected in series to the resistance, and the electrodes of the electron gun.

2 Claims, 3 Drawing Sheets

CATHODE-RAY TUBE WITH A COIL-SHAPED HIGH RESISTANCE BODY

FIELD OF THE INVENTION

The present invention concerns a cathode-ray tube with a coil-shaped high resistance body.

BACKGROUND OF THE INVENTION

Conventionally, the glass bulb 1 of a cathode-ray tube comprises a funnel portion 2, anode terminal 3 mounted on the funnel portion, and conducting layer 4 deposited on the inside of the funnel portion 2. The anode terminal 3 is overlapped by the conducting layer 4, and electrically connected to the electrode 12 of an electron gun 8 having conducting layers 5 and 6 and conducting metal 7, as shown in FIG. 1. To the inside of the panel 9 of the glass bulb 1 is attached a fluorescent film 10 and metal back 16 electrically connected to the anode terminal 3. The metal back 16 comprises a conducting panel 15, spring 17 for holding a mask, mask frame 13, conducting metal strip 14, and the conducting layer 4.

The equivalent circuit of this conventional cathode-ray tube is shown in FIG. 3A. A high voltage from the anode terminal 3 is applied through a high resistance body 5 (resistance R in FIG. 3A) to the electrodes 12 of an electron gun 8. In this case, there occurs frequently an electric discharge between the electrodes due to possible foreign matters such as dust, so that a discharging current of a high peak value as shown in FIG. 4A or 4B may flow to damage the circuit elements connected to the electrodes of the electron gun 8.

OBJECT OF THE PRESENT INVENTION

The object of the present invention is to provide an improved means for buffering or absorbing the discharging current so as to prevent the damaging of the circuit elements in the cathode-ray tube of a TV receiving system.

SUMMARY OF THE INVENTION

According to the present invention, there is provided a cathode-ray tube comprising a high voltage supplying means for supplying a high voltage to the electrodes of an electron gun, and discharging current buffering means for absorbing the discharging current caused by a foreign matter possibly present in the electron gun, whereby the TV receiving system is protected. The high voltage supplying means consists of an internal conducting layer.

The present invention will now be described with reference to the drawings attached only by way of example.

BRIEF DESCRIPTION OF THE ATTACHED DRAWINGS

DETAILED DESCRIPTION OF A CERTAIN PREFERRED EMBODIMENT

Figure 1:
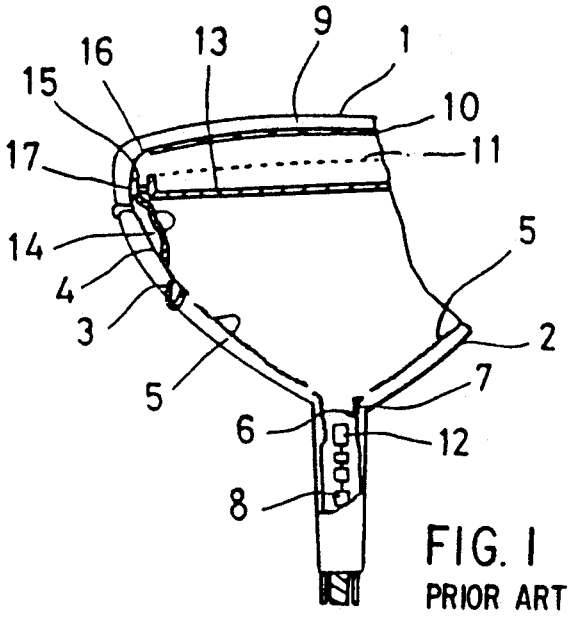
FIG. 1 PRIOR ART
FIG. 1 is a schematic cross-sectional view of a conventional cathode-ray tube.
Figure 2A:
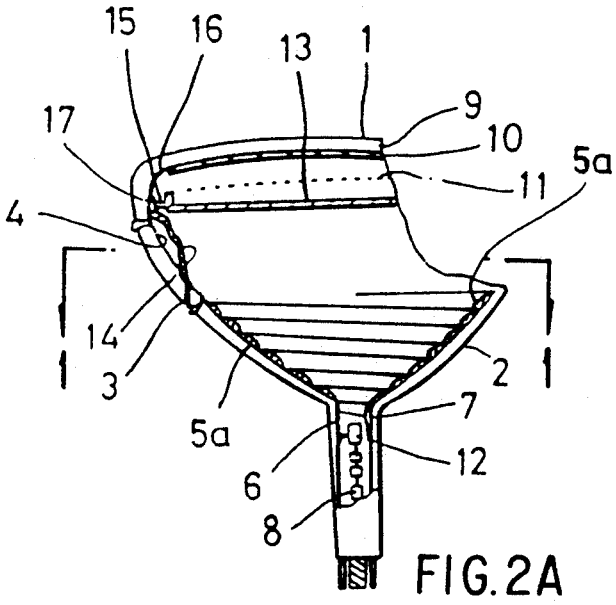
FIG. 2A is a schematic cross-sectional view of a cathode ray tube according to the present invention.
Figure 2B:
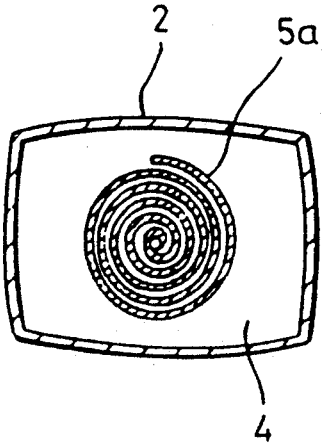
FIG. 2B is a cross-sectional view taken along line A—A' of FIG. 2A.

Referring to FIGS. 2A and 2B, an anode terminal 3 is attached to the funnel portion 2 of a glass bulb 1, and overlapped by a first conducting layer 4. An electron gun 8 comprises a coil-shaped high resistance body 5*a*, a second conducting layer 6 and a first metal strip 7. The anode terminal 3 is electrically connected to the electrode 12 of the electron gun 8.

To the inside of the panel 9 of the glass bulb are attached a fluorescent film 10 and metal back 16, which comprises a conducting panel pin 15, spring 17 for holding a mask, mask frame 13, second metal strip 14 and the first conducting layer 4. These are electrically connected to the anode terminal 3.

Figure 3A:
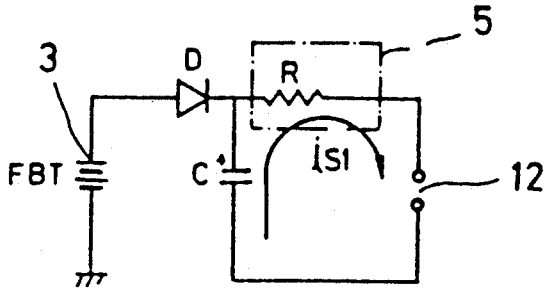
FIG. 3A PRIOR ART
FIG. 3A is an equivalent circuit of the conventional cathode-ray tube.
Figure 3B:
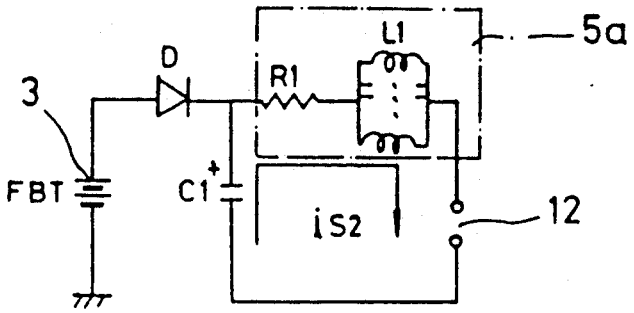
FIG. 3B is a an equivalent circuit of the inventive cathode-ray tube.

Referring to FIG. 3B, the equivalent circuit of the inventive cathode-ray tube using the coil-shaped high resistance body 5*a* comprises a resistance R1 and capacitance C1 connected in parallel, at least an inductance L1 connected in series to the resistance R1, and the electrodes 12 of the electron gun 8. The inductances are produced by the coil-shaped high resistance body 5*a*.

Figure 4:
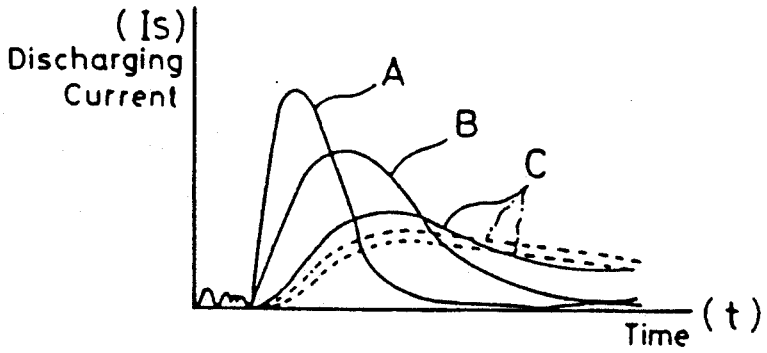
FIG. 4 illustrates the characteristic curves of the discharging current (Is) generated by the electrodes of electron guns, wherein A represents the case of using a low resistance body, B high resistance body, and C coil-shaped high resistance body.
Figure 5:
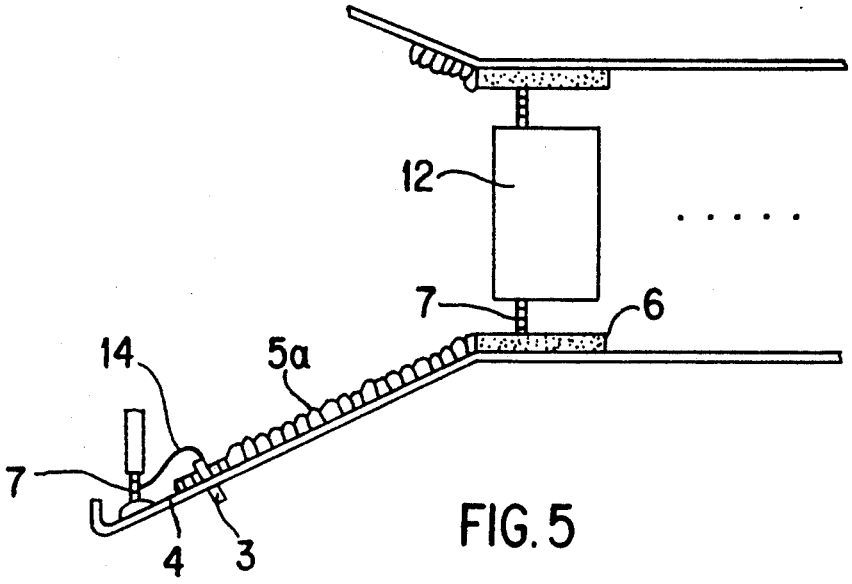
FIG. 5 is an enlarged, cut-away portion of FIG. 2A.

Hereinafter described is the operational effect of the inventive cathode-ray tube with reference to FIG. 4.

When a high voltage from the anode terminal is applied to the electrodes 12 of the electron gun 8, a possible foreign matter present in the tube causes the electrodes to generate a discharging current of a high peak value. This discharging current is buffered by the inductance L1 of the coil-shaped high resistance body 5*a*, considerably decreased as shown by the waveform C in FIG. 4. Thus, the transistors and IC elements of the TV receiving system are effectively protected.

As stated above, the inventive cathode-ray tube uses the coil-shaped high resistance body in order to buffer the discharging current of a high peak value caused by a possible foreign matter present in the tube, thus preventing the damaging of the circuit elements.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A cathode ray tube comprising:

a neck portion and funnel portion connected thereto;

an anode terminal in the funnel portion;

a first conducting layer connected electrically to the anode terminal and located on an inner surface of said funnel portion;

discharging current buffering means for reducing a peak value of a discharging current due to foreign matter in the CRT in order to prevent possible damage to components by taking advantage of an effect of inductance, said discharging current buffering means located on an inner surface of said funnel portion;

a second conducting layer formed on an inner surface of said neck portion of the CRT;

a final electrode in the neck portion; and a metal strip connecting the second conducting layer to the final electrode, wherein said anode terminal, said first conducting layer, said discharging current buffering means, said second conducting layer, said metal strip, and said final electrode being electrically connected in series to make an equipotential region of high voltage.

2. A cathode ray tube as claimed in claim 1, wherein said discharging current buffering means comprises at least one coil-shaped high resistance body having a set value of inductance.

* * * * *